US008041041B1

(12) United States Patent
Luo et al.

(10) Patent No.: US 8,041,041 B1
(45) Date of Patent: Oct. 18, 2011

(54) METHOD AND SYSTEM FOR PROVIDING STEREO-CHANNEL BASED MULTI-CHANNEL AUDIO CODING

(75) Inventors: Fa-Long Luo, San Jose, CA (US); Zhenyu Wei, Guangzhou (CN); Xiang Wan, Guangzhou (CN); Norman Hu, San Jose, CA (US)

(73) Assignee: Anyka (Guangzhou) Microelectronics Technology Co., Ltd., Guangdon (CN)

( * ) Notice: Subject to any disclaimer, the term of this patent is extended or adjusted under 35 U.S.C. 154(b) by 1129 days.

(21) Appl. No.: 11/443,878

(22) Filed: May 30, 2006

(51) Int. Cl.
*H04R 5/00* (2006.01)

(52) U.S. Cl. ..... 381/23; 381/22; 381/19; 381/20; 704/500; 704/501

(58) Field of Classification Search ..... 381/1, 17, 381/27, 119, 310, 2, 19–23, 309; 704/500–504; 700/94
See application file for complete search history.

(56) References Cited

U.S. PATENT DOCUMENTS 6,307,941 B1 * 10/2001 Tanner et al. ..... 381/17
2004/0076301 A1 * 4/2004 Algazi et al. ..... 381/17
2006/0177078 A1 * 8/2006 Chanda et al. ..... 381/309
2008/0002842 A1 * 1/2008 Neusinger et al. ..... 381/119

OTHER PUBLICATIONS

Baumgarte and Faller, Binaural Cue Coding-Part I: Psychoacoustic Fundamentals and Desing Principles, IEEE Transactions on Speech and Audio Processing, vol. 11, No. 6, Nov. 2003.*

* cited by examiner

*Primary Examiner* — Vivian Chin
*Assistant Examiner* — Friedrich W Fahnert
(74) *Attorney, Agent, or Firm* — SNR Denton US LLP

(57) ABSTRACT

A system for generating stereo-channel audio signals with surround information is disclosed. The system includes a surround mapping unit configured to receive signals from a number of audio channels and generate a pair of stereo-channel audio signals based on the audio channels. The pair of stereo-channel audio signals includes binaural and spatial information. The system also includes a stereo-channel encoder configured to receive and encode the pair of stereo-channel audio signals from the surround mapping unit thereby generating a pair of encoded stereo-channel audio signals. The system further includes a stereo-channel decoder configured to receive and decode the pair of encoded stereo-channel audio signals thereby obtaining the pair of stereo-channel audio signals. The pair of stereo-channel audio signals are capable of being used to generate surround effect.

14 Claims, 7 Drawing Sheets

METHOD AND SYSTEM FOR PROVIDING STEREO-CHANNEL BASED MULTI-CHANNEL AUDIO CODING

BACKGROUND

1. Field

The present invention generally relates to digital signal processing and, more specifically, to a method and system for providing stereo-channel based multi-channel audio coding.

2. Background

Multi-channel audio transmission techniques are increasingly used in modern multi-media and communication systems. However, delivering multi-channel audio contents in mobile multi-media systems, such as, handheld devices in an efficient manner remains difficult. This is because multi-channel coding systems require a much higher bit rate and are more complex than stereo-channel or mono-channel systems. To handle this problem, a spatial audio coding method has recently been proposed by ISO/MPEG. This coding method can deliver a low bit presentation of multi-channel signals by transmitting a downmix signal along with some compact surround information, such as, binaural cues and spatial information, which describes the most salient properties of the multi-channel signals. Furthermore, the spatial audio coding method produces signals that are backward compatible with existing transmission systems.

FIG. 1 is a simplified schematic diagram illustrating a spatial surround coding system 10 recently developed by ISO/MPEG. The surround coding system 10 includes an encoder side 12 and a decoder side 14. The encoder side 12 further includes a downmix operation unit 16, a stereo-channel encoder 18 and a side information processing unit 20. The decoder side 14 further includes a stereo-channel decoder 22 and a surround synthesis processing unit 24.

The downmix operation unit 12 accomplishes the linear mapping from N-channel signals to stereo-channel with a 2×N coefficient matrix. After this mapping, the stereo-channel signals can be coded by the stereo-channel encoder 18, such as, an AAC encoder or MP3 encoder. The stereo-channel encoder 18 then generates data that is in stereo-compressed (two-channel) format. The side information processing unit 20 extracts and codes side information including the most important binaural cues and sound spatial information, such as, inter-channel level difference (ICLD), inter-channel time difference (ICTD) and inter-channel coherence (ICC) among these N channels. Side information can be represented and transmitted with a rate of only a few kb/s. As a result, the total data that will be transmitted to the decoder side 14 includes data in stereo-compressed format and the side information.

On the decoder side 14, the stereo-channel decoder 22 first decodes the stereo-compressed data. The decoded or decompressed data is forwarded to the surround synthesis processing unit 24. The surround synthesis processing unit 24 then uses signal synthesis (inverse processing corresponding to the extraction part on the encoder side 12) to combine the side information (such as, ICTD, ICLD and ICC) with the decompressed data to derive the N-channel signals for playback.

For the headphone or the case where there are only two speakers on the playback side, two options are available on the decoder side 14 to handle the stereo-channel signals. One option is that the stereo-channel decoder 22 directly outputs the stereo-channel signals, $\hat{x}_l(n)$ and $\hat{x}\ r(n)$, to the headphone or two speakers. Such direct output, however, will not produce any significant surround effect since binaural and spatial information are not included in these stereo-channel signals. The other option, as shown in FIG. 2, is to use a virtual surround mapping unit 26 to map the synthesized N-channel signals to two channels, $\hat{s}_l(n)$ and $\hat{s}_r(n)$. This can deliver multi-channel surround effect for the headphone or the listeners in the sweet-spot of two speakers. By using the virtual surround mapping unit 26, however, additional processing resources are needed on the decoder side 14.

The surround synthesis processing unit 24 and the virtual surround mapping unit 26 perform very intensive computations. As a result, it is very difficult and cost inefficient to implement and include these units 24, 26 in portable devices, thereby preventing portable devices from delivering multi-channel surround effect in many mobile multi-media systems.

Hence, it would be desirable to provide a coding system which, amongst other things, allows portable devices with existing stereo-channel decoders to deliver multi-channel contents for headphones without adding any processing resources.

SUMMARY

In one embodiment, a system for generating stereo-channel audio signals is disclosed. The system includes a surround mapping unit configured to receive signals from a number of audio channels and generate a pair of stereo-channel audio signals based on the audio channels. The pair of stereo-channel audio signals includes binaural and spatial information (such as, ICTD, ICLD and ICC). The system also includes a stereo-channel encoder configured to receive and encode the pair of stereo-channel audio signals from the surround mapping unit thereby generating a pair of encoded stereo-channel audio signals. The system further includes a stereo-channel decoder configured to receive and decode the pair of encoded stereo-channel audio signals thereby obtaining the pair of stereo-channel audio signals. The pair of stereo-channel audio signals are capable of being used to generate surround effect.

In another embodiment, a system for generating audio signals is disclosed. The system includes an encoder component having: control logic configured to receive signals from a number of audio channels and map the received signals to generate a pair of stereo-channel audio signals, the pair of stereo-channel audio signals including binaural and spatial information; and control logic configured to encode the pair of stereo-channel audio signals thereby generating a pair of encoded stereo-channel audio signals; and a decoder component configured to receive and decode the pair of encoded stereo-channel audio signals thereby obtaining the pair of stereo-channel audio signals. The pair of stereo-channel audio signals are capable of being used to generate surround effect.

It is understood that other embodiments of the present invention will become readily apparent to those skilled in the art from the following detailed description, wherein various embodiments of the invention are shown and described by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION

The detailed description set forth below in connection with the appended drawings is intended as a description of various embodiments of the present invention and is not intended to represent the only embodiments in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

Figure 3:
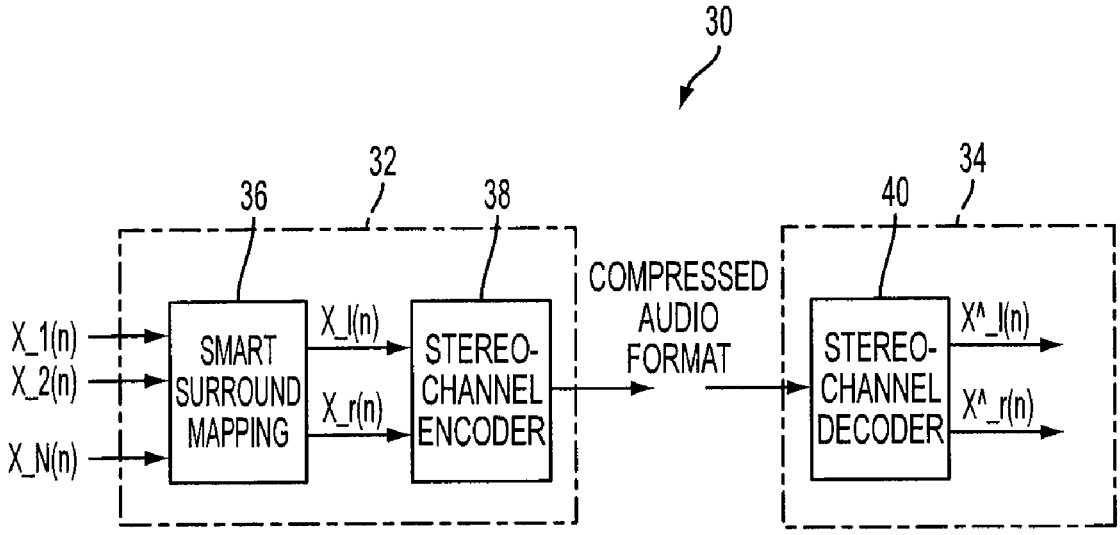
FIG. 3 is a simplified schematic diagram illustrating one embodiment of the present invention.

One or more embodiments of the present invention will now be described. FIG. 3 illustrates one embodiment of the present invention. In this embodiment, the system 30 includes an encoder side 32 and a decoder side 34. The encoder side 32 further includes a smart surround mapping unit 36 and a stereo-channel encoder 38. The decoder side 34 includes a stereo-channel decoder 40 without any other processing unit.

Figure 1:
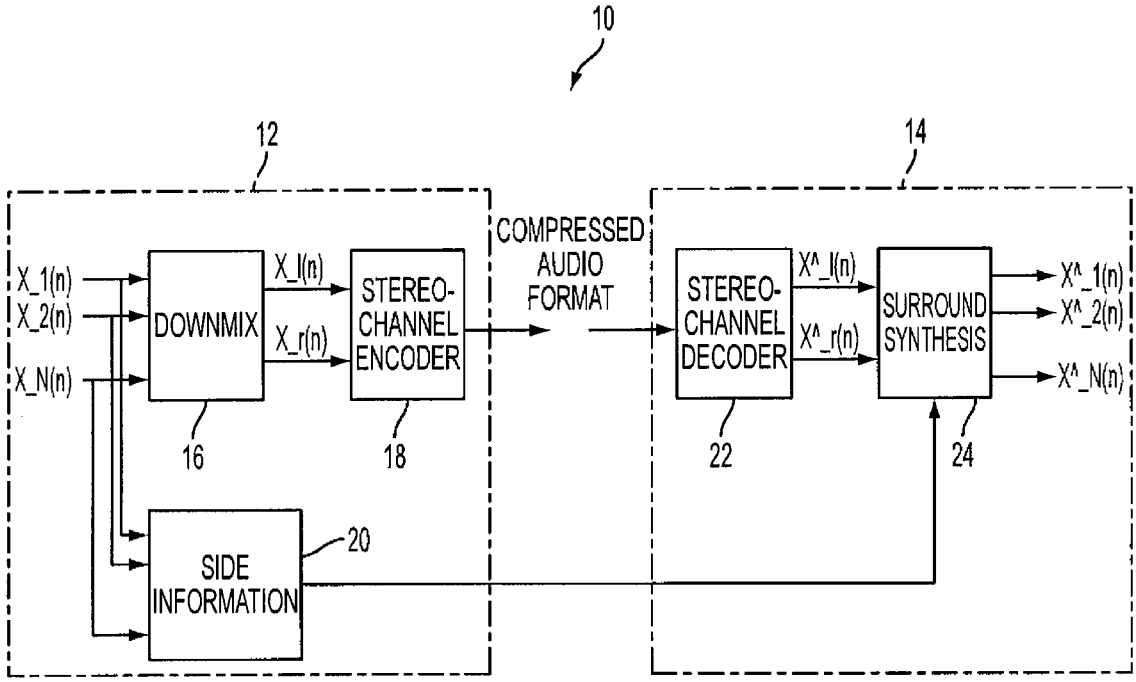
FIG. 1 is a simplified schematic diagram illustrating a conventional spatial surround coding system.
Figure 2:
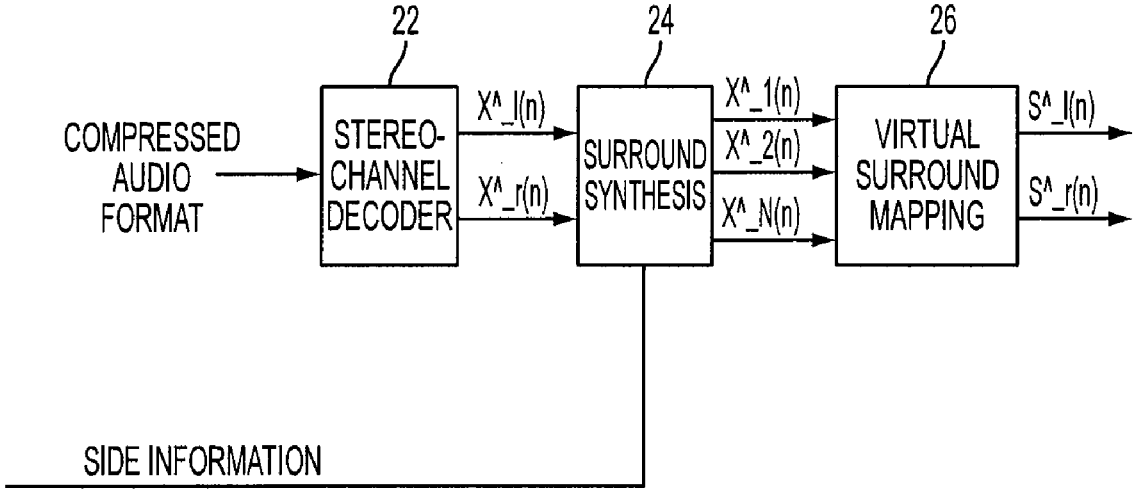
FIG. 2 is a simplified schematic diagram illustrating a processing scheme on the decoder side of a conventional spatial surround coding system.

Unlike the downmix operations unit 16 in FIG. 1, the smart surround mapping unit 36 is employed to transfer and directly integrate the surround information including all important binaural cues and sound spatial information into two channels x_l(n) and x_r(n).

Figure 4:
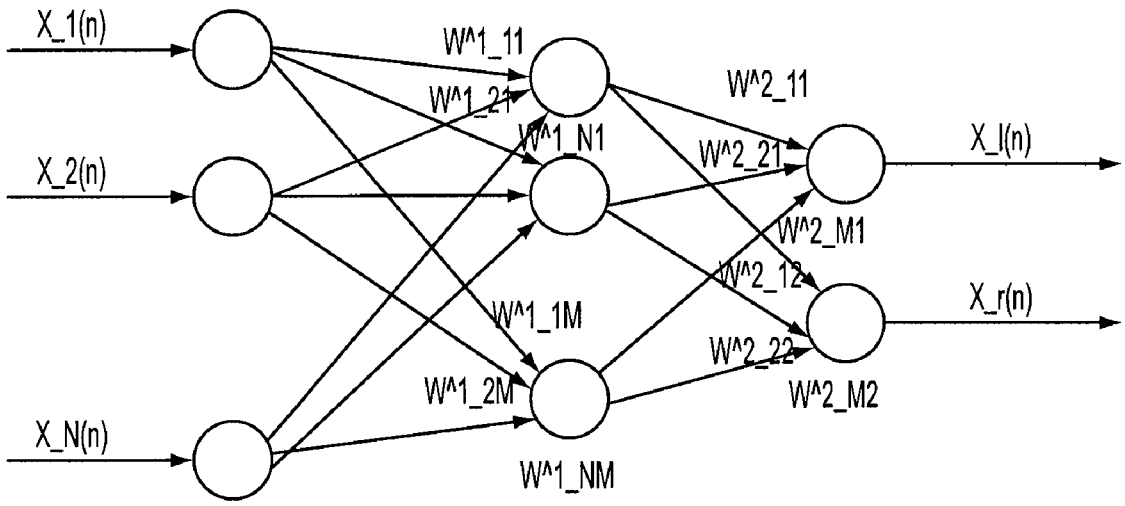
FIG. 4 is a simplified schematic diagram illustrating a nonlinear surround mapping scheme according to one embodiment of the present invention.

FIG. 4 illustrates a nonlinear surround mapping scheme used in the smart surround mapping unit 36. The scheme includes three layers of nodes. The scheme is in effect a multiplayer (three) perceptron network defined in the book entitled "*Applied Neural Networks for Signal Processing*" by Fa-Long Luo and Rolf Unbehauen (Cambridge University Press, New York, 1999). Under this scheme, the nonlinear mapping relationship between the inputs and the outputs is uniquely determined by the weights and activation function of each node. The activation function f(.) is usually a sigmoid function or piece-wise linear function.

With this scheme, the outputs after this mapping processing can be written as follows:

$$X_l(n) = f\left(\sum_{i=1}^{M} W_{i1}^2 f\left(\sum_{j=1}^{N} W_{ji}^1 X_j(n)\right)\right) \quad \text{Eq. (1)}$$

-continued $$X_r(n) = f\left(\sum_{i=1}^{M} W_{i2}^2 f\left(\sum_{j=1}^{N} W_{ji}^1 X_j(n)\right)\right)$$

where $W_{ik}^2$, $W_{ji}^1$ (k=1, 2, i=1, 2, . . . M, j=1, 2, . . . N) are the connection weights from the second layer to the third layer, and from the first layer to the second layer, respectively. In this illustration, there are N nodes in the first layer (the same number as that of the audio channels to be coded), M nodes in the second layer and two nodes in the third layer. As shown in FIG. 4, output from each of the N nodes in the first layer is provided to all the M nodes in the second layer; similarly, output from each of the M nodes in the second layer is provided to the two nodes in the third layer. It should be noted that the number of M nodes in the second layer may vary depending on the system design and/or constraints.

In order to include the surround information including the important binaural and sound spatial formation contained in the N-channel audio signals in the output signals, x_l(n) and x_r(n), all the connection weights are empirically determined by solving an optimization problem under some criterion in offline training mode. Such criterion can be the least-squared criterion or maximum entropy criterion. Since these weights can be pre-determined, the complexity of deriving such weights does not have any impact on the real-time implementation of the system 30. This allows the best training algorithm to be chosen from the performance point of view without compromising its complexity. It should be noted that, in addition to the nonlinear surround mapping scheme shown in FIG. 4, other virtual surround mapping techniques for headphones and two-speaker systems may be used. In the case of two-speaker system, cross-talk cancellation processing may be included.

The smart surround mapping unit 36 thus produces two-channel audio signals, x_l(n) and x_r(n), containing the surround information including the important binaural and spatial information relating to sound image. The two-channel audio signals can then be compressed independently by the stereo-channel encoder 38. For best result, the two-channel audio signals should be encoded independently instead of being encoded correlatively as in a joint-stereo encoder. The compressed two-channel audio signals are then forwarded to the decoder side 34 for playback. The compressed two-channel audio signals may be transmitted to the decoder side 34 in a number of ways including, for example, wired and wireless communications. For instance, the compressed audio signals may be forwarded from the encoder side 32 to the decoder side 34 via a circuit connection, a cable or a computer network, such as, the Internet. In another instance, the compressed audio signals may be forwarded using over-the-air or wireless transmission techniques.

The decoder side 34 includes the stereo-channel decoder 40 that is configured to decode the compressed two-channel audio signals encoded by the corresponding stereo-channel encoder 38. Output from the stereo-channel decoder 40 provides the surround audio effect when using a headphone to playback the signals.

It should be noted that the encoder side 32 and the decoder side 34 may or may not reside within the same device, depending on the system design and configuration. For example, in a configuration where the encoder side 32 transmits the compressed two-channel audio signals to the decoder side 34 in a wireless manner, the encoder side 32 may reside in a transmitting component, such as, a transmitting station and the decoder side 34 may reside in a portable media player.

Figure 5:
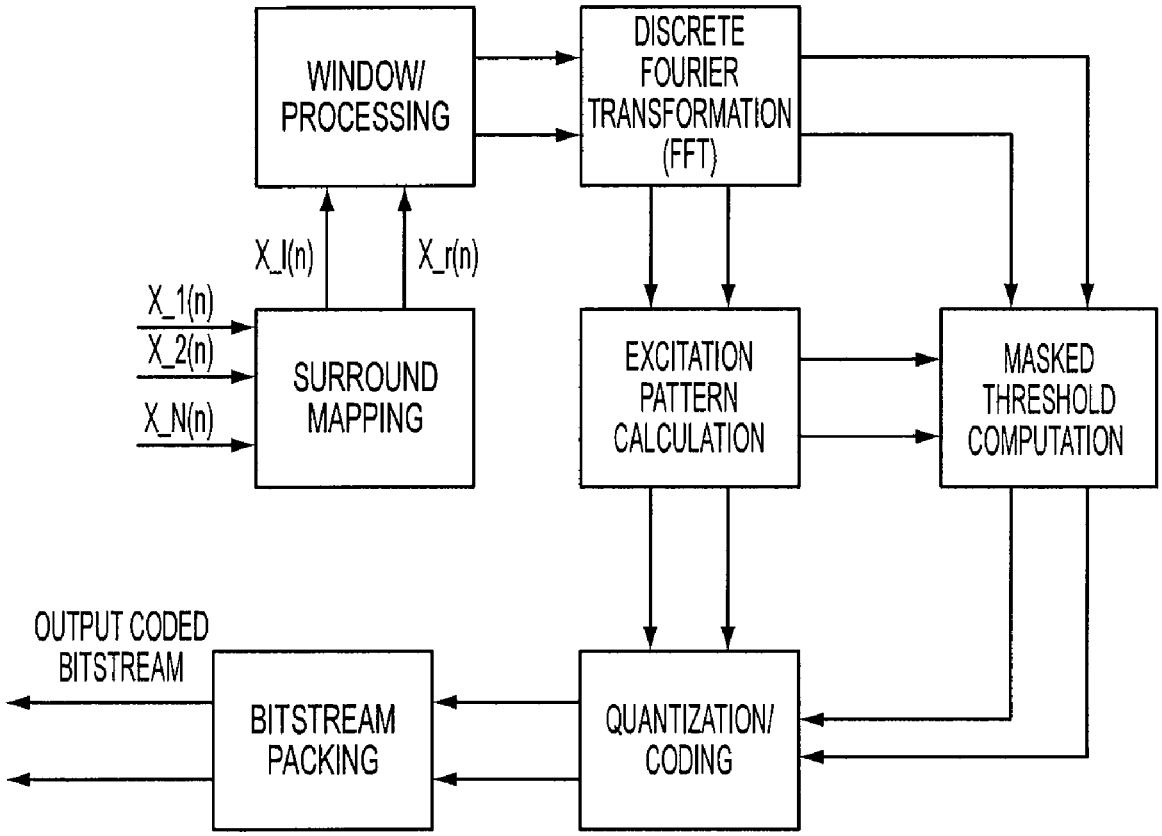
FIG. 5 is a simplified schematic diagram further illustrating an implementation of one embodiment of the present invention.

FIG. 5 further illustrates an implementation of the system 10 using transforming domain and perceptual properties (masking-effect and frequency resolution) of an auditory system. The implementation is further described as follows. The connection weights $W_{ik}^2$, $W_{ji}^1$ (k=1, 2, i=1, 2, . . . M, j=1, 2, . . . N) for use in the surround mapping scheme in the smart surround mapping unit 36 are determined in off-line training mode. Eq. (1) is used to derive the stereo-channel outputs, x_l(n) and x_r(n), for the smart surround mapping unit 36.

The left channel output x_l(n) generated by the smart surround mapping unit 36 is transformed to frequency domain by performing windowing processing and FFT (Fast Fourier Transform).

The transformed outputs are then used to calculate the excitation pattern. This involves calculating the output of an array of simulated auditory filters in response to the magnitude spectrum. Each side of each auditory filter is modeled as an intensity-weighting function, assumed to have the following form:

$$w(f) = \left(1 + p\frac{|f - f_c|}{f_c}\right)\exp\left(-p\frac{|f - f_c|}{f_c}\right) \quad \text{Eq. (2)}$$

where fc is the center frequency of the filter and p is a parameter determining the slope of the filter skirts. The value of p is assumed to be the same for the two sides of the filter. The equivalent rectangular bandwidth (ERB) of these filters is 4fc/p. According to the calculation of ERB given in the reference (*Spectral Contrast Enhancement: Algorithm and Comparisons*, Jun Yang, Fa-Long Luo and Arye Nehorai, Speech Communication, Vol. 39, No. 1, 2003, pp. 33-46), the following is derived:

$$p\frac{f - f_c}{f_c} = \frac{4(f - f_c)}{f_c(0.00000623f_c + 0.09339) + 28.52} \quad \text{Eq. (3)}$$

The masked threshold is then computed according to rules known from psychoacoustics, the transformed outputs and the excitation pattern obtained above. It should be noted that the magnitude spectrum will be replaced by the corresponding excitation pattern in using the known rules to calculate the masked threshold.

Bit-allocation processing is then performed to allocate different bits for different frequency bins according to the respective magnitudes of the excitation pattern and the masked threshold.

All frequencies with different bits are then coded in terms of the bit allocation results. Other coding techniques such as Huffman coding could be used as well.

The above operations are then repeated for the right channel output x_r(n).

Bitstream packing assembles the bitstream of the two channels including some extra information, such as, bit allocation information that may be used on the decoder side. The corresponding decoder should be the counterpart of the encoder and is able decode the compressed audio signals.

The decoder side performs inverse processing of the above operations, including depacking of the compressed audio stream, inverse-quantization, IFFT, and window-overlap adding processing.

The present invention provides a number of advantages and/or benefits. For example, computational complexity is highly reduced. On the encoder side, surround information (binaural and spatial information) need not be extracted or derived separately. On the decoder side, neither surround synthesis processing nor surround mapping units are needed. Furthermore, any conventional decoder can be used to decode regular stereo-channel audio signals as well as the two-channel audio signals which are mapped from the multi-channel audio signals. In other words, all current stereo-channel based audio player can deliver multi-channel surround effect via a headphone or a two-speaker system without adding any processing and hardware. Moreover, on the encoder side, surround mapping is completely independent of the stereo-channel encoder. This means that there is no need to make any changes on the existing stereo-channel encoder with respect to processing algorithm and data format packing. Also, the bit rate of the encoding scheme used in the present invention is even lower than that for MPEG surround since no surround information needs to be transmitted.

Figure 6:
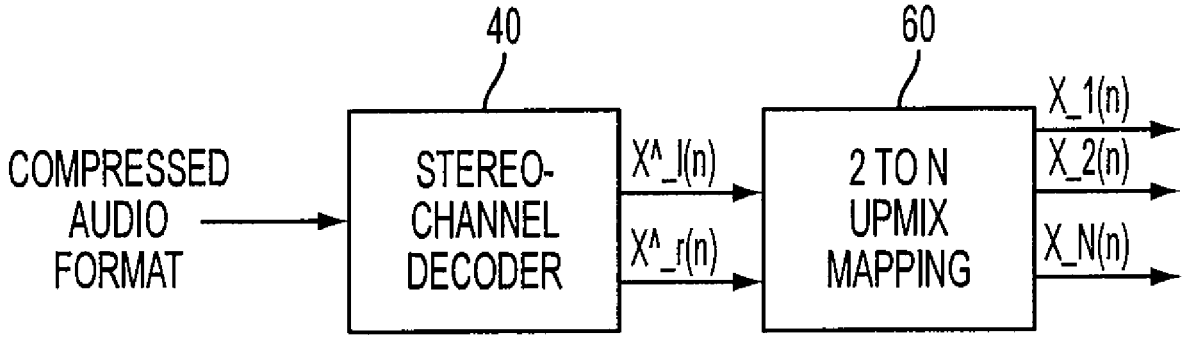
FIG. 6 is a simplified schematic diagram illustrating one post-processing scheme according to one embodiment of the present invention.
Figure 7:
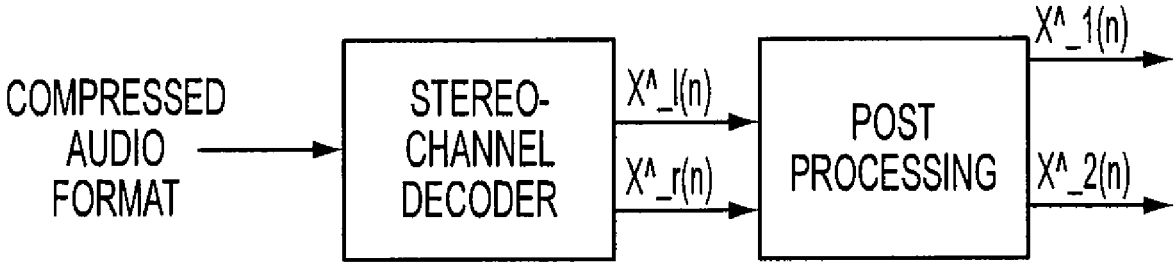
FIG. 7 is a simplified schematic diagram illustrating one post-processing scheme according to another embodiment of the present invention.

The present invention can also be suitable for two-speaker playback system as long as the listeners are at the sweet spot. Also, in an alternative embodiment as shown in FIG. 6, upmix technology (an N×2 coefficient matrix which maps the two-channel decoded signals to N channels) can be used to provide outputs to N speakers. The upmix mapping unit 60 provides post-processing after the stereo-channel decoder without affecting the stereo-channel decoder itself at all. In other alternative embodiments, one of which is shown in FIG. 7, all post-processing techniques, such as, base enhancement, noise reduction, and equalization can be added immediately following the stereo-channel decoder.

The various illustrative logical blocks, modules, circuits, elements, and/or components described in connection with the embodiments disclosed herein may be implemented or performed with a general purpose processor, a digital signal processor (DSP), an application specific integrated circuit (ASIC), a field programmable gate array (FPGA) or other programmable logic component, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing components, e.g., a combination of a DSP and a microprocessor, a number of microprocessors, one or more microprocessors in conjunction with a DSP core, or any other such configuration.

The methods or algorithms described in connection with the embodiments disclosed herein may be embodied directly in hardware, in a software module executable by a processor, or in a combination of both, in the form of control logic, programming instructions, or other directions, and may be contained in a single device or distributed across multiple devices. A software module may reside in RAM memory, flash memory, ROM memory, EPROM memory, EEPROM memory, registers, hard disk, a removable disk, a CD-ROM, or any other form of storage medium known in the art. A storage medium may be coupled to the processor such that the processor can read information from, and write information to, the storage medium. In the alternative, the storage medium may be integral to the processor.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit of scope of the invention. Thus, the present invention is not intended to be limited to the embodiments shown herein, but is to be accorded the full scope consistent with the claims, wherein reference to an element in the singular is not intended to mean "one and only one" unless specifically so stated, but rather "one or more". All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for".

What is claimed is:

1. A system for generating audio signals, comprising:

a surround mapping unit configured to receive input audio signals having surround sound information contained therein from a plurality of audio channels and generate, via a nonlinear surround mapping scheme, a pair of output stereo-channel audio signals based on the input audio signals, where the pair of output stereo-channel audio signals are embedded with surround sound information, including binaural cues and sound spatial image information; and a stereo-channel encoder configured to encode the pair of output stereo-channel audio signals generated by the surround mapping unit to produce a pair of encoded stereo-channel audio signals with the surround sound information, including binaural cues and sound spatial image information, wherein the pair of encoded stereo-channel audio signals with the surround sound information is transmitted to a stereo-channel decoder via one channel, and the surround sound information included in the pair of encoded stereo-channel audio signals is capable of being used by the stereo-channel decoder to generate surround sound effect.

2. The system of claim 1 wherein the nonlinear surround mapping scheme uses a plurality of node layers, each node layer having a plurality of nodes;

wherein output of each node in a first node layer is forwarded to each and every node in a second node layer.

3. The system of claim 1 wherein the pair of encoded stereo-channel audio signals are forwarded to the stereo-channel decoder via wired communications.

4. The system of claim 1 wherein the pair of encoded stereo-channel audio signals are forwarded to the stereo-channel decoder via wireless communications.

5. The system of claim 1 further comprising a post-processing unit configured to receive the pair of stereo-channel audio signals from the stereo-channel decoder and generate a plurality of outputs based on the pair of stereo-channel audio signals.

6. The system of claim 1 wherein the surround mapping unit and the stereo-channel encoder reside in a transmitting component; and wherein the stereo-channel decoder resides in a receiving component.

7. The system of claim 6 wherein the transmitting component and the receiving component do not reside in the same device; and wherein the receiving component includes a portable media player.

8. A system for generating audio signals, comprising:

an encoder component having:

control logic configured to receive input audio signals having surround sound information contained therein from a plurality of audio channels and generate, via a nonlinear surround mapping scheme, a pair of output stereo-channel audio signals based on the input audio signals, where the pair of output stereo-channel audio signals are embedded with surround sound information, including binaural cues and sound spatial image information; and control logic configured to encode the pair of output stereo-channel audio signals to produce a pair of encoded stereo-channel audio signals with surround sound information, including binaural cues and sound spatial image information, wherein the pair of encoded stereo-channel audio signals with the surround sound information is transmitted to a stereo-channel decoder via one channel, and the surround sound information included in the pair of encoded stereo-channel audio signals is capable of being used by the stereo-channel decoder to generate surround sound.

9. The system of claim 8 wherein the nonlinear surround mapping scheme uses a plurality of node layers, each node layer having a plurality of nodes;

wherein output of each node in a first node layer is forwarded to each and every node in a second node layer.

10. The system of claim 8 wherein the pair of encoded stereo-channel audio signals are forwarded to the decoder component via wired communications.

11. The system of claim 8 wherein the pair of encoded stereo-channel audio signals are forwarded to the decoder component via wireless communications.

12. The system of claim 8 wherein the decoder component is further configured to generate a plurality of outputs based on the pair of stereo-channel audio signals.

13. The system of claim 8 wherein the encoder component resides in a transmitting component; and wherein the decoder component resides in a receiving component.

14. The system of claim 8 wherein the transmitting component and the receiving component do not reside in the same device; and wherein the receiving component includes a portable media player.

* * * * *